US007069131B2

(12) United States Patent
Kim

(10) Patent No.: US 7,069,131 B2
(45) Date of Patent: Jun. 27, 2006

(54) APPARATUS FOR SETTING FUNCTION OF SWITCHES OF CONSTRUCTION VEHICLE

(75) Inventor: Dong Soo Kim, Changwon (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 10/890,741

(22) Filed: Jul. 14, 2004

(65) Prior Publication Data

US 2005/0228548 A1 Oct. 13, 2005

(30) Foreign Application Priority Data

Apr. 13, 2004 (KR) ..... 10-2004-0025295

(51) Int. Cl.
*G06F 19/00* (2006.01)
*G06F 7/70* (2006.01)

(52) U.S. Cl. ..... 701/50; 701/1

(58) Field of Classification Search ..... 701/49, 701/36, 1, 50, 69; 307/10; 414/699; 37/348, 37/382, 907; 340/425.5, 426, 443, 449; G06F 7/70, G06F 19/00
See application file for complete search history.

(56) References Cited

U.S. PATENT DOCUMENTS 4,288,196 A * 9/1981 Sutton, II ..... 414/699
4,324,525 A * 4/1982 Lane et al. ..... 414/699
4,791,549 A * 12/1988 Heiser et al. ..... 700/65
4,844,658 A * 7/1989 Kohn ..... 405/159
4,889,466 A * 12/1989 Jindai et al. ..... 414/694
4,934,463 A * 6/1990 Ishida et al. ..... 172/4.5
4,964,779 A * 10/1990 Sagaser ..... 414/708
5,188,502 A * 2/1993 Tonsor et al. ..... 414/700
5,257,193 A * 10/1993 Kusaka et al. ..... 701/110
5,583,844 A * 12/1996 Wolf et al. ..... 701/1
5,844,556 A * 12/1998 Takitani et al. ..... 715/764
6,134,494 A * 10/2000 Stelzle et al. ..... 701/50
6,173,225 B1 * 1/2001 Stelzle et al. ..... 701/50
6,184,779 B1 * 2/2001 Chen ..... 340/425.5
6,202,780 B1 * 3/2001 Tanaka et al. ..... 180/179
6,205,385 B1 * 3/2001 Stelzle et al. ..... 701/50
6,209,408 B1 * 4/2001 DeJonge et al. ..... 74/335
6,704,637 B1 * 3/2004 Hrazdera et al. ..... 701/93
2003/0001734 A1 * 1/2003 Schofield et al. ..... 340/442
2003/0033067 A1 * 2/2003 Arita et al. ..... 701/48
2004/0004316 A1 * 1/2004 Robertson ..... 267/64.26
2004/0130442 A1 * 7/2004 Breed et al. ..... 340/443

FOREIGN PATENT DOCUMENTS

WO WO 9211418 A1 * 7/1992

* cited by examiner

*Primary Examiner*—Cuong Nguyen
(74) *Attorney, Agent, or Firm*—Ladas and Parry LLP

(57) ABSTRACT

The present invention relates to an apparatus for setting a function of switches of a construction vehicle, enabling a construction vehicle driver to freely set or arrange the switches as desired, so that the driver feels more convenient to use the switches and thus, the work efficiency can be improved. Preferably, the apparatus includes a plurality of switches for generating an on/off signal; a controller for receiving a signal from the switches and outputting a driving signal to drive the work equipments; a plurality of driving units for driving the work equipments; a memory for storing relations between the switches and the driving units driven by the switches; and a pattern editing unit which includes a display screen and a plurality of input buttons, whereby a construction vehicle driver can change the relations between the switches and the driving units, the relations being stored in the memory.

3 Claims, 4 Drawing Sheets

APPARATUS FOR SETTING FUNCTION OF SWITCHES OF CONSTRUCTION VEHICLE

BACKGROUND OF THE INVENTION

1. Field of the Invention

The present invention relates in general to switches of a construction vehicle, and more particularly, to an apparatus for setting a function of switches of a construction vehicle, whereby function of each switch required for driving work equipment of a construction vehicle can be freely set.

2. Description of the Related Art

In general, a construction vehicle like an excavator is provided with basic work equipments such as a boom, arm, bucket, and swing motor, and also additional work equipments such as a rotator, hammer, and power boost. The boom or the arm is driven when hydraulic fluid is supplied to a hydraulic cylinder with the spool of a control valve moving according to control signal from an operation lever. On the other hand, the rotator starts or stops when a switch generates an on or off signal.

In effect, there is a plurality of switches for driving the additional work equipment. They are located on the handle of the operation lever and feature an ergonomic design so that a driver can freely operate the switches during driving. One switch corresponds to one specific work equipment. Because the switches are arranged at the handle of the operation lever, the driver is able to immediately operate any equipment during driving, which enhances convenience for drivers.

Unfortunately however, the arrangement of the switches varies according to manufacturers. For instance, if a driver is familiar with the arrangement (or setting) of switches for one construction vehicle of a particular manufacturer, he would feel inconvenient in driving another construction vehicle of a different manufacturer where the arrangement of switches is totally different from the one he is accustomed to.

In addition, switches are typically put together to perform a certain function. Therefore, in some cases, switches that a driver seldom uses could be installed on the handle of the operation lever and the switches that the driver uses frequently are not installed on the handle of the operation lever. This contradicts the original primary purpose of the switches for maximizing drivers' convenience.

For the above reasons, there is a great need to develop a technique that allows the drivers to freely set function and arrangement of the switches on the operation lever as they desired.

SUMMARY OF THE INVENTION

It is, therefore, an object of the present invention to provide an apparatus for setting a function of switches of a construction vehicle, enabling a construction vehicle driver to freely set or arrange the switches as desired, so that the driver feels more convenient to use the switches and thus, the work efficiency can be improved.

To achieve the above object, there is provided an apparatus for setting a function of switches of a construction vehicle, in which a function setting pattern is stored in a controller memory of the apparatus and a driver is permitted to freely set a function of switches by means of a pattern editing unit.

One aspect of the invention provides an apparatus for setting a function of switches of a construction vehicle, the apparatus including: a plurality of switches for generating an on/off signal to drive a plurality of work equipments respectively; a controller for receiving a signal from the switches and outputting a driving signal to drive the work equipments; a plurality of driving units for driving the work equipments, each driving unit being driven by the driving signal from the controller; a memory built in the controller for storing relations between the switches and the driving units driven by the switches; and a pattern editing unit, which can communicates with the controller, and includes a display screen and a plurality of input buttons, through which a construction vehicle driver can change the relations between the switches and the driving units, the relations being stored in the memory.

Preferably, the controller includes: a plurality of input ports to which on/off signals of the switches are inputted; a plurality of output ports connected to the respective driving units; and a CPU for outputting a signal from the input port to corresponding output port thereof according to the relations stored in the memory.

Preferably, each of the driving units includes: an amplifier connected to the output port for amplifying a driving signal from the controller; and a driving valve being driven by the amplified signal, and driving the work equipment.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
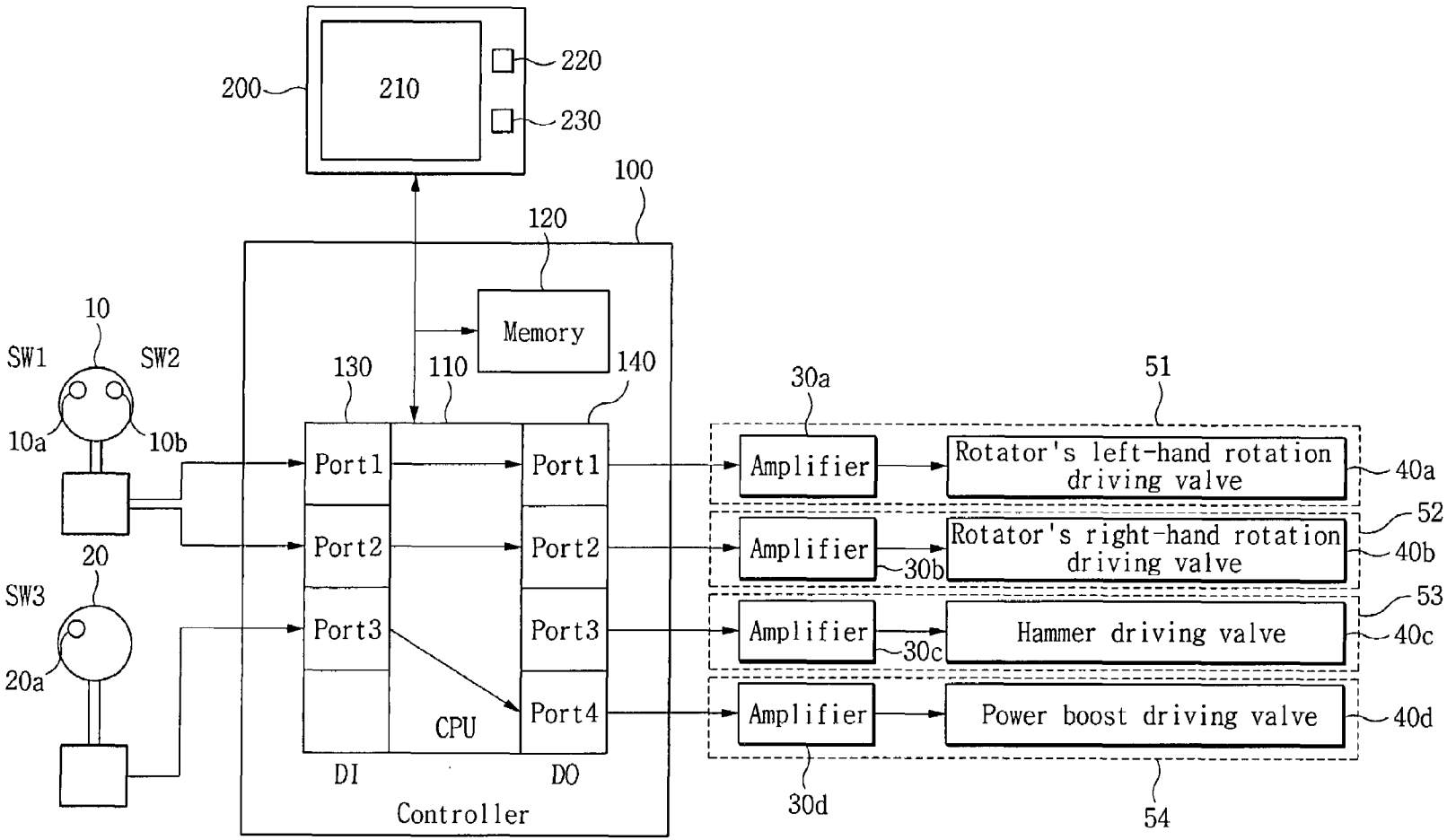
FIG. 1 is a schematic diagram of an apparatus for setting a function of switches of a construction vehicle according to one embodiment of the present invention.

FIG. 1 is a schematic diagram of an apparatus for setting a function of switches of a construction vehicle according to one embodiment of the present invention.

The apparatus for setting a function of switches of a construction vehicle includes a plurality of switches 10*a*, 10*b*, and 20*a*, a controller 100, a plurality of driving units 51, 52, 53, and 54, a memory 120 built in the controller 100, and a pattern editing unit 200.

The switches 10*a*, 10*b*, and 20*a* are installed on operation levers 10, 20, and generate an on/off signal for driving a plurality of work equipments (not shown). The controller 100 receives a signal from the switches 10*a*, 10*b*, and 20*a*, and outputs a driving signal for driving work equipments (not shown).

The driving units 51, 52, 53, and 54 are connected to the work equipments, and driven by a driving signal from the controller 100 to drive the respective work equipment (not shown). The memory 120 is built in the controller 100, and stores relations between the switches 10*a*, 10*b*, and 20*a* and the driving units 51, 52, 53, and 54 which are driven by the switches 10*a*, 10*b*, and 20*a*.

The pattern editing unit 200 is installed in a manner to communicate with the controller 100. The pattern editing unit 200 includes a display screen 210 and input buttons 220 and 230. Its main job is to change the relations between the switches 10*a*, 10*b*, and 20*a* and the driving units 51, 52, 53, and 54 and set a new relation. The input buttons includes a first button 220 and a second button 230. By pressing the first and second buttons 220 and 230, a construction vehicle driver is able to select one of items displayed on the display screen 210 and set a desired function to a particular switch.

More specifically speaking on the structure of the controller 100, the controller 100 includes the memory 120 described above, a plurality of input ports DI 130, a plurality of output ports DO 140, and a CPU 110.

The input ports DI 130 receive on/off signals from the switches 10*a*, 10*b*, and 20*a*, and the output ports DO 140 send signals received from the input ports DI 130 to the outside. The CPU 110 outputs a signal from the input port DI 130 to its corresponding output port DO 140 according to the relations stored in the memory 120.

The driving units 51, 52, 53, and 54, respectively include an amplifier 30*a*, 30*b*, 30*c*, or 30*d* and a driving valve 40*a*, 40*b*, 40*c* or 40*d*. Each amplifier is connected to one output port DO 140, and amplifies a driving signal received from the controller 100. This amplified driving signal is used to drive the driving valve and the driving valve in turn drives work equipment.

The following will now explain the operation of the apparatus for setting a function of switches for a construction vehicle having the above structure.

The controller 100 receives an on/off signal of the respective switches 10*a*, 10*b*, and 20*a* through the input ports DI 130. The CPU 110 reads out the information stored in the memory about the relations between the switches and the driving units, namely switching patterns of the input ports and the output ports, and matches the input ports DI 130 to the output ports DO 140, and then outputs a signal from the switches 10*a*, 10*b*, and 20*a* to the output ports DO 140.

As shown in FIG. 1, the input ports 1, 2, and 3 correspond to the output ports 1, 2, and 4, respectively. Therefore, a signal from the switch SW1 10*a* is transferred to the port 1 of the output ports DO, a signal from the switch SW2 10*b* is transferred to the port 2 of the output ports DO, and a signal from the switch SW3 20*a* is transferred to the port 4 of the output ports DO.

According to the relations, the switches SW1 10*a*, SW2 10*b*, and SW3 20*a*, respectively execute a rotator's driving (or turning) to the left direction, a rotator's driving (or turning) to the right direction, and a power boost's driving.

The relations stored in the memory 120 can be changed through the operation of the pattern editing unit 200. For example, as shown in FIG. 1, if the construction vehicle driver changes the relations so that the input port 3 can correspond to the output port 3 and then stores this change in the memory 120, the function of the switch SW3 20*a* is changed to a hammer driving switch from then.

Besides the driving valves for work equipment of FIG. 1, a person skilled in the art will be able to easily modify or change the structure of the apparatus to operate a horn or other electric units for example.

Figure 2:
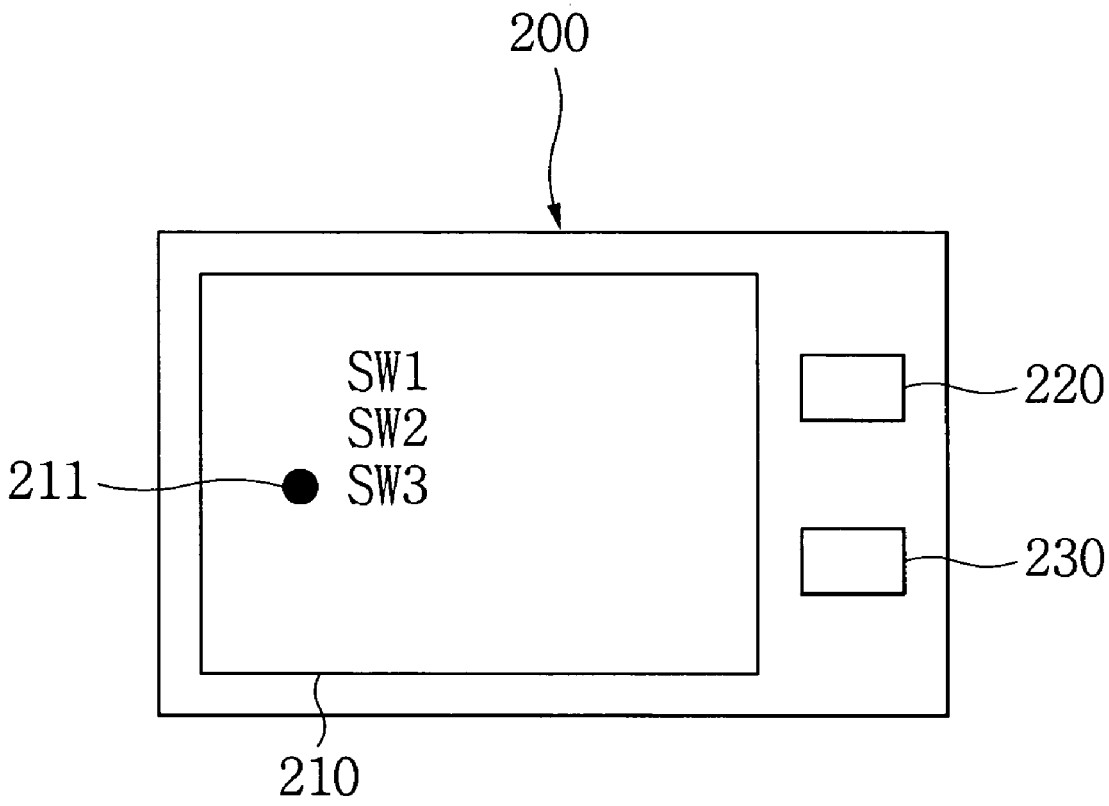
FIG. 2 is a plane view of a pattern editing unit in an apparatus for setting a function of switches of a construction vehicle according to one embodiment of the present invention.
Figure 3:
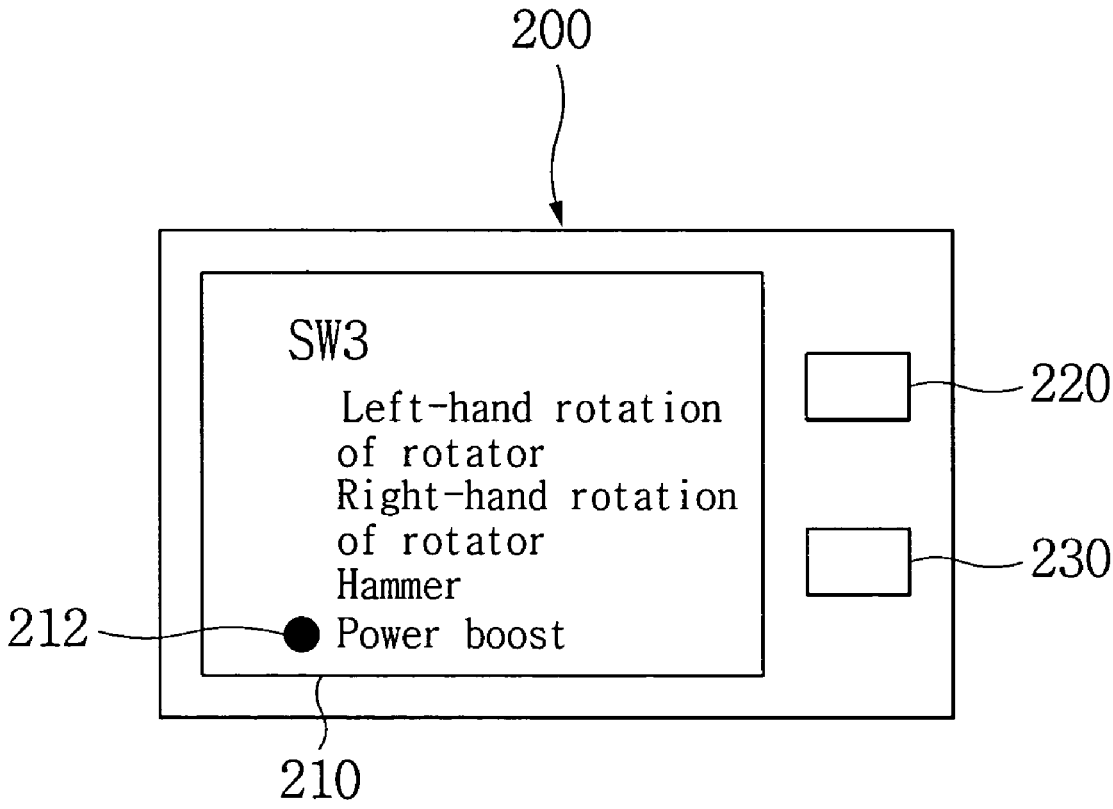
FIG. 3 is an exemplary diagram of a pattern editing unit of FIG. 2, in which a function of switch 3 is set.

FIG. 2 is a plane view of the pattern editing unit in the apparatus for setting a function of switches of a construction vehicle according to one embodiment of the present invention, and FIG. 3 is an exemplary diagram of the pattern editing unit of FIG. 2, in which a function of switch 3 is set.

The method for changing the relations (which is stored in the memory 120) between the switches 10*a*, 10*b*, and 20*a* and the driving units 51, 52, 53, and 54 and for storing the change in the memory 120 will be explained as follows.

First of all, if the pattern editing unit 200 is ready to operate, the display screen 210 displays a screen similar to one of FIG. 2. The "SW1 ", "SW2", and "SW3" on the screen 210 denote the switches 10*a*, 10*b*, and 20*a*, respectively and an item setting symbol 211 moves up and down along the character string, thereby allowing the driver to select the item he wants to change. For instance, every time the driver presses the first button 220, the item setting symbol 211 moves between the items "SW1", "SW2", and "SW3". Suppose that the driver pressed the second button 230 while the item setting symbol 211 is next to the "SW3". Then the screen of FIG. 2 turns to another screen shown in FIG. 3, displaying functions of the SW3 20*a*.

As it has been noted already, FIG. 3 illustrates the functions the switch SW3 20*a* carries out.

Each character string "Left-hand rotation", "Right-hand rotation", "Hammer", and "Power boost" indicates functions set on the switch SW3 20*a*. Each time the driver presses the first button 220, the item setting symbol 212 moves between the item setting symbols 210.

Therefore, the driver presses the first button 220 to place the item selection symbol 212 at a desired item, and presses the second button 230 to change the relations between the switches 10*a*, 10*b*, and 20*a* and the driving units 51, 52, 53, and 54, that is, the switching pattern of the input ports DI 130 and the output ports DO 140.

When a key (not shown) of the construction vehicle is turned off after the relations are changed through the operation of the pattern editing unit 200, the changed relations are stored in the memory 120 of the controller 100. Later when the key (not shown) of the construction vehicle is turned on again, the CPU 110 reads out the changed relations stored in the memory 120 and matches the input ports DI 130 to the output ports DO 140 on the basis of the new relations, and outputs a signal to the output port DO 140.

Besides the "Left-hand rotation", "Right-hand rotation", "Hammer", and "Power boost", a person skilled in the art will be able to easily expand more functions by adding more electric units like a horn that can be operated by the output signal from the controller 100. Hence, it is possible to make a greater number of functions be executed by one switch, which resultantly gives more options to the driver.

Figure 4:
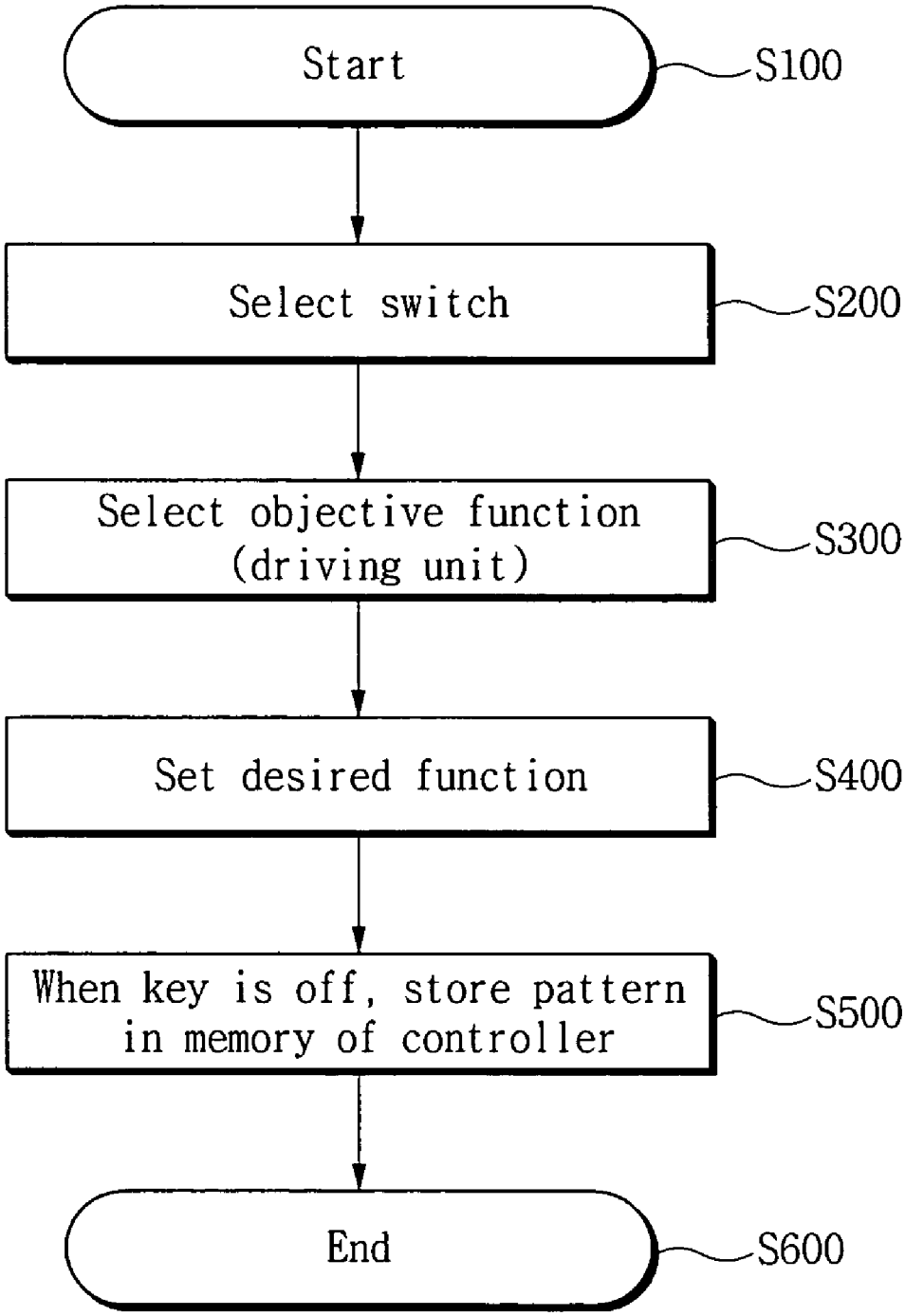
FIG. 4 is a flow chart describing how to set a function of switches by an apparatus for setting a function of switches of a construction vehicle according to one embodiment of the present invention.

FIG. 4 is a flow chart describing how to set a function of switches by the apparatus for setting a function of switches of a construction vehicle according to one embodiment of the present invention. As described in FIG. 4, the pattern editing unit 200 is used to change the relations stored in the memory 120 and to store the changed relations in the memory 120 again.

The method for setting a function of switches using the pattern editing unit 200 includes the steps of: selecting a switch (S200), selecting an objective function (S300), setting a function (S400), and storing a changed pattern (S500).

To operate the pattern editing unit 200, the driver first needs to operate a selection switch (not shown) of the construction vehicle. Once the pattern editing unit 200 starts operating, the screen shown in FIG. 2 is displayed and the driver can start setting a desired function of switches (S100).

The screen shown in FIG. 2 corresponds to the switch selecting step (S200). In this step, the driver presses the first button 220 to place the item selection symbol 211 at one of the switches "SW1", "SW2", and "SW3", and then presses the second button 230 to select a switch he wants to change a function thereof.

The screen shown in FIG. 3 corresponds to the selecting an objective function step (S300). In this step, the driver sets an objective function to a selected switch by pressing the first button 220. That is to say, the driver needs to press the first button 220 in order to place the item selection symbol 212 at the objective function among the "Left-hand rotation", "Right-hand rotation", "Hammer", and "Power boost".

When the item selection symbol 212 is placed next to the objective function, the driver presses the second button 230 to set the objective function selected in the step 300 to the corresponding switch (S400).

Finally, the changed relation in the function setting step (S400) is stored in the memory 120 of the controller 100 (S500). This is accomplished by turning off the key (not shown) of the construction vehicle. When the changed relation is stored in the memory 120 of the controller 100, the method for setting the function of switches is complete (S600).

To operate the respective switches 10*a*, 10*b*, and 20*a* according to the changed relations stored in the memory 120, the driver simply needs to turn on the key (not shown) of the construction vehicle again. Once the key (not shown) is turned on, the CPU 110 reads out the changed relations from the memory 120 and matches the input ports DI 130 to the output ports DO 140 according to the new relations, and outputs a signal to the output port DO 140. As a result, each switch is now ready to carry out its function according to the new pattern.

In conclusion, the apparatus for setting a function of switches of a construction vehicle of the present invention enables a construction vehicle driver to freely set or arrange the switches as desired, so that the driver feels more convenient to use the switches and thus, the work efficiency can be improved.

While the invention has been described in conjunction with various embodiments, they are illustrative only. Accordingly, many alternative, modifications and variations will be apparent to persons skilled in the art in light of the foregoing detailed description. The foregoing description is intended to embrace all such alternatives and variations falling with the spirit and broad scope of the appended claims.

The invention claimed is:

1. In a construction vehicle having work equipments, the improvements comprising apparatus for setting functions of switches of the construction vehicle, the apparatus comprising:

the switches for providing respective on/off signals;

a controller for receiving the on/off signals and outputting driving signals;

a plurality of driving units for respectively driving the work equipments of the construction vehicle, the driving units being driven by the driving signals;

a memory in the controller for setting relations between the switches and the driving units; and a pattern editing unit including a display screen and a plurality of input buttons for changing the relations between the switches and the driving units set in the memory.

2. The apparatus according to claim 1, wherein the controller comprises:

a plurality of input ports to which on/off signals of the switches are inputted;

a plurality of output ports connected to the respective driving units; and a CPU for outputting a signal from the input port to corresponding output port thereof according to the relations stored in the memory.

3. The apparatus according to claim 2, wherein each of the driving units comprises:

an amplifier connected to the output port for amplifying a driving signal from the controller; and a driving valve being driven by the amplified signal, and driving the work equipment.

* * * * *